US006497200B2

(12) United States Patent
Stretch et al.

(10) Patent No.: US 6,497,200 B2
(45) **Date of Patent: *Dec. 24, 2002**

(54) FUEL-FIRED HEATING APPLIANCE WITH COMBUSTION CHAMBER TEMPERATURE-SENSING COMBUSTION AIR SHUTOFF SYSTEM

(75) Inventors: Gordon W. Stretch, Montgomery, AL (US); John H. Scanlon, Montgomery, AL (US); Gary A. Elder, Montgomery, AL (US); James T. Campbell, Wetumpka, AL (US); Larry D. Kidd, Nashville, MI (US); Eric M. Lannes, Kentwood, MI (US)

(73) Assignee: The Water Heater Industry Joint Research and Development Consortium, Rio Verde, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/801,551

(22) Filed: Mar. 8, 2001

(65) Prior Publication Data

US 2002/0124814 A1 Sep. 12, 2002

(51) Int. Cl.[7] ..... F22B 37/42

(52) U.S. Cl. ..... 122/504; 122/504.1; 122/504.3; 122/DIG. 7; 122/13.01; 122/14.1; 122/19.2; 126/287.5; 126/112

(58) Field of Search ..... 122/13.01, 14.1, 122/17.1, 17.2, 18.31, 19.2, 504, 504.1, 504.3, 507, DIG. 7; 126/112, 287.5; 431/21, 22, 77

(56) References Cited

U.S. PATENT DOCUMENTS

| | | | | |
|---|---|---|---|---|
| 1,834,645 | A | 12/1931 | Ryan | |
| 3,625,289 | A | 12/1971 | Gloeckler | 169/39 |
| 3,633,676 | A | 1/1972 | Gloeckler | 169/40 |
| 3,777,696 | A | 12/1973 | Bilbrey | 116/114.5 |
| 3,779,004 | A | 12/1973 | Gloeckler | 59/93 |
| 3,874,456 | A | 4/1975 | Gloeckler | 169/39 |
| 4,290,440 | A | 9/1981 | Sturgis | 137/75 |
| 4,362,146 | A | 12/1982 | Schuller | 126/77 |
| 4,375,273 | A | 3/1983 | Erb et al. | 236/21 R |

(List continued on next page.)

FOREIGN PATENT DOCUMENTS

EP 0 040 373 A1 11/1981

OTHER PUBLICATIONS

Star Sprinkler Catalog Sheets—Sep., 1992.
Battelle Final Report Report "Evaluation of FireXX . . ."— Aug. 15, 1994.

*Primary Examiner*—Jiping Lu
(74) *Attorney, Agent, or Firm*—Konneker & Smith, P.C.

(57) ABSTRACT

A gas-fired water heater has a combustion chamber with a bottom wall defined by a perforated flame arrestor plate forming a portion of a flow path through which combustion air may be supplied to a burner s structure within the combustion chamber. During firing of the water heater a combustion air shutoff system senses an undesirable temperature increase in the combustion chamber, caused by for example a partial blockage of the flow path, and responsively terminates further air flow into the combustion chamber, thereby shutting down the burner, prior to the creation in the combustion chamber of a predetermined elevated concentration of carbon monoxide.

67 Claims, 7 Drawing Sheets

U.S. PATENT DOCUMENTS

| | | | | |
|---|---|---|---|---|
| 4,646,847 | A | 3/1987 | Colvin | 169/49 |
| 4,757,865 | A | 7/1988 | Simons | 169/39 |
| 4,977,963 | A | 12/1990 | Simons | 169/37 |
| 5,072,792 | A | 12/1991 | Simons et al. | 169/37 |
| 5,134,683 | A | 7/1992 | Powell | 392/449 |
| 5,143,050 | A | 9/1992 | Spivey | 126/374 |
| 5,195,592 | A | 3/1993 | Simons | 169/37 |
| 5,234,059 | A | 8/1993 | Eynon | 169/39 |
| 5,280,802 | A | 1/1994 | Comuzie, Jr. | 137/65 |
| 5,372,203 | A | 12/1994 | Galaszewski | 169/37 |
| 5,402,603 | A | 4/1995 | Henley | 48/192 |
| 5,794,707 | A | 8/1998 | Alhamad | 169/69 |
| 5,797,355 | A | 8/1998 | Bourke et al. | 122/13.1 |
| 5,941,200 | A | 8/1999 | Boros et al. | 122/13.1 |
| 6,003,477 | A | 12/1999 | Valcic | 122/13.1 |
| 6,035,812 | A | 3/2000 | Harrigill et al. | 122/504 |
| 6,082,310 | A | 7/2000 | Valcic et al. | 122/14 |
| 6,085,699 | A | 7/2000 | Valcic et al. | 122/13.1 |
| 6,085,700 | A | 7/2000 | Overbey | 122/13.1 |
| 6,116,195 | A | 9/2000 | Valcic et al. | 122/13.1 |
| 6,135,061 | A | 10/2000 | Valcic et al. | 122/13.1 |
| 6,138,613 | A | 10/2000 | Bourke et al. | 122/13.1 |
| 6,142,106 | A | 11/2000 | Overbey, Jr. et al. | 122/5.51 |
| 6,155,211 | A | 12/2000 | Valcic et al. | 122/13.1 |
| 6,223,697 | B1 * | 5/2001 | Overbey, Jr. | 122/13.01 |

* cited by examiner

FIG.5
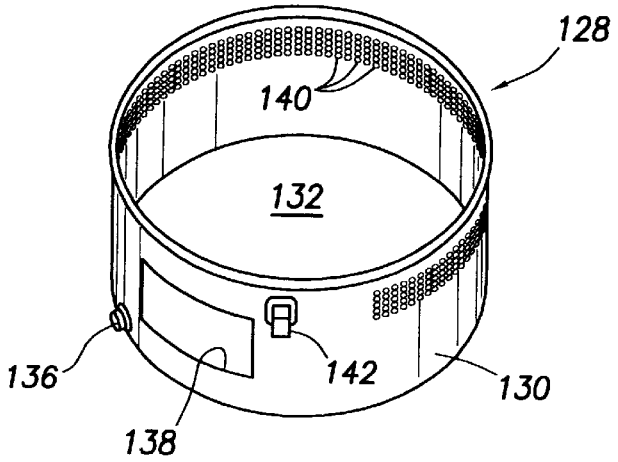
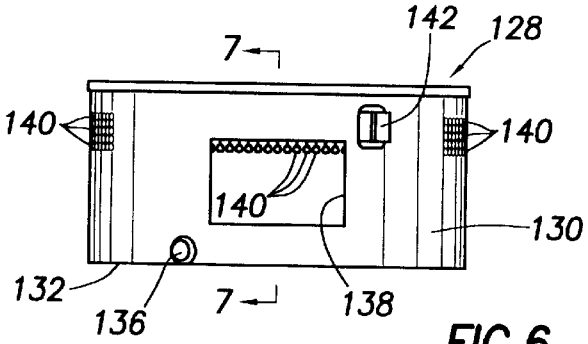
FIG.6
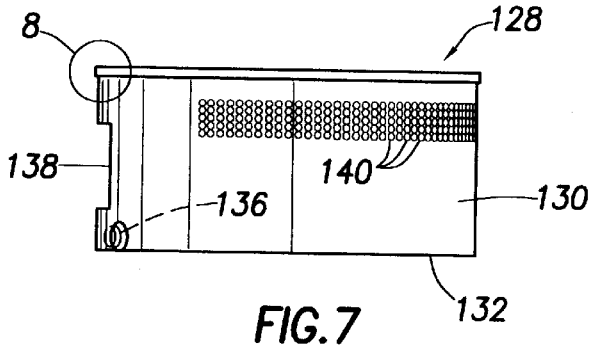
FIG.7
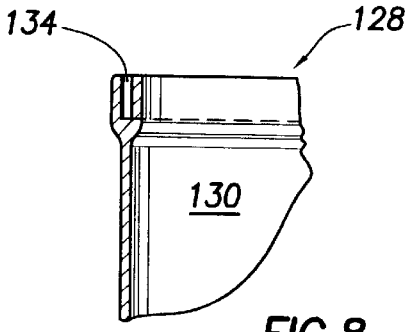
FIG.8
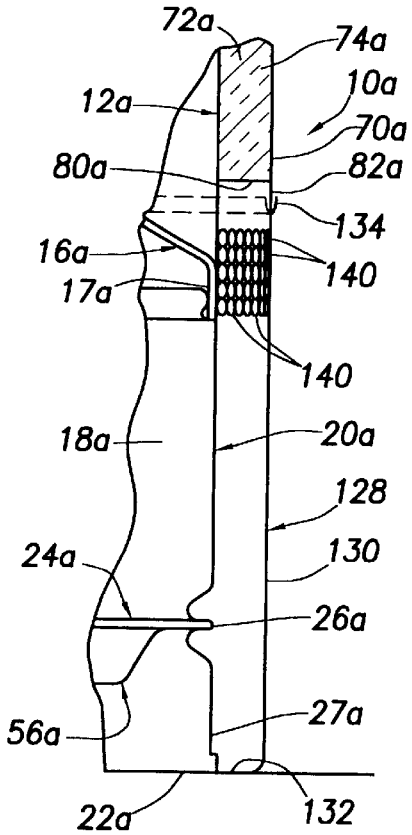
FIG.9

FUEL-FIRED HEATING APPLIANCE WITH COMBUSTION CHAMBER TEMPERATURE-SENSING COMBUSTION AIR SHUTOFF SYSTEM

BACKGROUND OF THE INVENTION

The present invention generally relates to fuel-fired heating appliances and, in a preferred embodiment thereof, more particularly provides a gas-fired water heater having incorporated therein a specially designed combustion air shutoff system.

Gas-fired- residential and commercial water heaters are generally formed to include a vertical cylindrical water storage tank with a gas burner disposed in a combustion chamber below the tank. The burner is supplied with a fuel gas through a gas supply line, and combustion air through an air inlet flow path providing communication between the exterior of the water heater and the interior of the combustion chamber.

Water heaters of this general type are extremely safe and quite reliable in operation. However, under certain operational conditions the temperature and carbon monoxide levels within the combustion chamber may begin to rise toward undesirable magnitudes. Accordingly, it would be desirable, from an improved overall control standpoint, to incorporate in this type of fuel-fired water heater a system for sensing these operational conditions and responsively terminating the firing of the water heater. It is to this goal that the present invention is directed.

SUMMARY OF THE INVENTION

In carrying out principles of the present invention, in accordance with a preferred embodiment thereof, fuel-fired heating apparatus is provided which is representatively in the form of a gas-fired water heater and includes a combustion chamber thermally communicatable with a fluid to be heated, and a burner structure associated with the combustion chamber and operative to receive fuel from a source thereof. A wall structure defines a flow path through which combustion air may flow into the combustion chamber for mixture and combustion with fuel received by the burner structure to create hot combustion products within the combustion chamber.

The water heater also incorporates therein a specially designed combustion air shutoff system, operative in response to an increased combustion temperature within the combustion chamber created by a reduction in the quantity of combustion air entering the combustion chamber via the flow path (caused, for example, by a progressive clogging of the flow path), for terminating combustion air supply to the combustion chamber, to thus terminate firing of the burner structure, prior to the creation in the combustion chamber of a predetermined elevated concentration of carbon monoxide therein. Representatively, this predetermined elevated concentration of carbon monoxide is in the range of from about 200 ppm to about 400 ppm by volume.

According to one aspect of the invention in a preferred embodiment thereof, the burner structure is disposed within the combustion chamber, a bottom wall of the combustion chamber is defined by an arrestor plate having a perforated portion defined by a series of flame quenching openings extending through the plate, and the combustion air shutoff system includes a temperature sensing structure extending through the arrestor plate into the interior of the combustion chamber, preferably adjacent the burner structure therein.

The temperature sensing structure functions to sense a predetermined, undesirably elevated combustion temperature within the combustion chamber, which may be caused by a reduction in the quantity of air being delivered to the combustion chamber via the flow path, or by burning in the combustion chamber of extraneous flammable vapor which has entered its interior through the arrestor plate flame quenching openings, and responsively activate the balance of the combustion air shutoff system to terminate further air inflow into the combustion chamber.

In accordance with a feature of the invention, the temperature sensing structure includes a collar axially projecting into the combustion chamber, a rod coaxially received in the collar and slidably bearing against a laterally crimped collar area, and a esthetic structure carried by the collar and releasably preventing movement of the rod through the collar into the combustion chamber. An open-topped pan structure is supported beneath the arrestor plate and has a bottom wall opening beneath which a shutoff damper is supported in an open position beneath the bottom pan wall opening. The temperature sensing rod releasably blocks the upward movement of the damper to a closed position in which it covers and blocks the pan wall opening, and a spring structure resiliently biases the damper upwardly toward this closed position.

The damper is representatively disposed within an interior plenum area in the water heater which is communicated with a perforated inlet air pre-filtering section disposed on an exterior sidewall portion of the water heater, the combustion air flow path sequentially extending from this pre-filtering section inwardly through the plenum, the interior of the pan structure, and through the arrestor plate flame quenching openings into the interior of the combustion chamber. When the set point of the esthetic temperature sensing structure is reached within the combustion chamber, the esthetic material melts, thereby permitting the spring to upwardly drive the damper to its closed position while at the same time s driving the rod upwardly through the collar into the combustion chamber interior.

According to another feature of the invention, the geometries of the pre-filter structure and the arrestor plate are correlated in a manner facilitating the aforementioned combustion air shutoff, in response to the presence in the combustion chamber of an undesirably increased temperature during firing of the burner structure due, for example, to a progressive clogging of the combustion air inlet flow path, prior to the creation in the combustion chamber of a predetermined elevated concentration of carbon monoxide. From a broad perspective, this correlation involves the relative sizing of the pre-filter structure and arrestor plate perforations in a manner such that the pre-filter structure does not block all potentially clogging airborne particulate matter from entering the combustion air inlet path, but permits a substantial portion of such airborne matter to come into contact with the pre-filter structure to pass through its perforations, traverse the air inlet flow path within the water heater, and come to rest on the bottom side of the arrestor plate.

Representatively, the pre-filter structure is disposed on an outer sidewall jacket portion of the water heater, and the geometries of the pre-filter structure and the arrestor plate are correlated in a manner such that (1) the ratio of the open area-to-total area percentage of the pre-filter structure to the open area-to-total area percentage of the arrestor plate is in the range of from about 1.2 to about 2.5, and (2) the ratio of the total open area of the pre-filter structure to the total open area of the arrestor plate is in the range of from about 2.5 to about 5.3.

In accordance with another feature of the invention, the water heater is provided with a specially designed bottom jacket pan structure that simplifies the construction and reduces the cost of the water heater. The bottom jacket pan structure is preferably of a one-piece molded plastic construction and has an open top side around which an annular, upwardly opening groove is formed. An annular lower end of the external sidewall jacket of the water heater is received in the pan groove, with a lower end portion of the balance of the water heater being downwardly received in the interior of the pan structure in an illustrated embodiment of the bottom jacket pan structure, various other portions of the water heater are integrally formed thereon, including a series of inlet air pre-filtering perforations, a burner access opening, a drain fitting, and a mounting structure for supporting a manual actuation portion of a piezo igniter structure.

According to a further feature of the present invention, the water heater is provided with a spaced series of perforated pre-filter panels, each representatively of a one piece molded plastic construction, which are releasably snap-fitted into corresponding openings in the outer metal jacket portion of the water heater. At the bottom of the outer frame portion of each panel is an upstanding shield structure positioned inwardly of the frame and defining therewith an open-ended trough at the bottom of the shield structure. In the event that a liquid is splashed into a lower portion of the panel it strikes the shield instead of contacting a bottom end portion of a perforated air inlet skirt portion of the water heater spaced inwardly apart from the panel. Liquid striking the shield drains downwardly along its outer side into the aforementioned trough and falls out of the open ends of the trough.

Projecting outwardly from the inner side of the shield are a horizontally spaced plurality of reinforcing tabs which may be brought into contact with the skirt portion of the water heater to limit undesirable inward deflection a portion of the outer jacket structure that extends along the bottom side of the panel's associated jacket opening.

While principles of the present invention are illustrated and described herein as being representatively incorporated in a gas-fired lo water heater, it will readily be appreciated by those skilled in this particular art that such principles could also be employed to advantage in other types of fuel-fired heating appliances such as, for example, boilers and other types of fuel-fired water heaters. Additionally, while a particular type of combustion air inlet flow path is representatively illustrated and described herein in conjunction with a water heater, it will also be readily appreciated by those skilled in this art that various other air inlet path and shutoff structure configurations could be utilized, if desired, to carry out the same general principles of the present invention.

BRIEF DESCRIPTION OF THE DRAWINGS

FIG. 5 is a perspective view of a specially designed bottom jacket pan which may be utilized in the water heater;

FIG. 6 is a side elevational view of the bottom jacket pan;

FIG. 7 is a cross-sectional view through the bottom jacket pan taken along line 7—7 of FIG. 6;

FIG. 8 is an enlargement of the circled area "8" in FIG. 7 and illustrates a portion of an annular, jacket edge-receiving support groove extending around the open top end of the bottom jacket pan;

FIG. 9 is a simplified partial cross-sectional view through a bottom end portion of a first alternate embodiment of the FIG. 1 water heater incorporating therein the bottom jacket pan shown in FIGS. 5–8;

DETAILED DESCRIPTION

Figure 1:
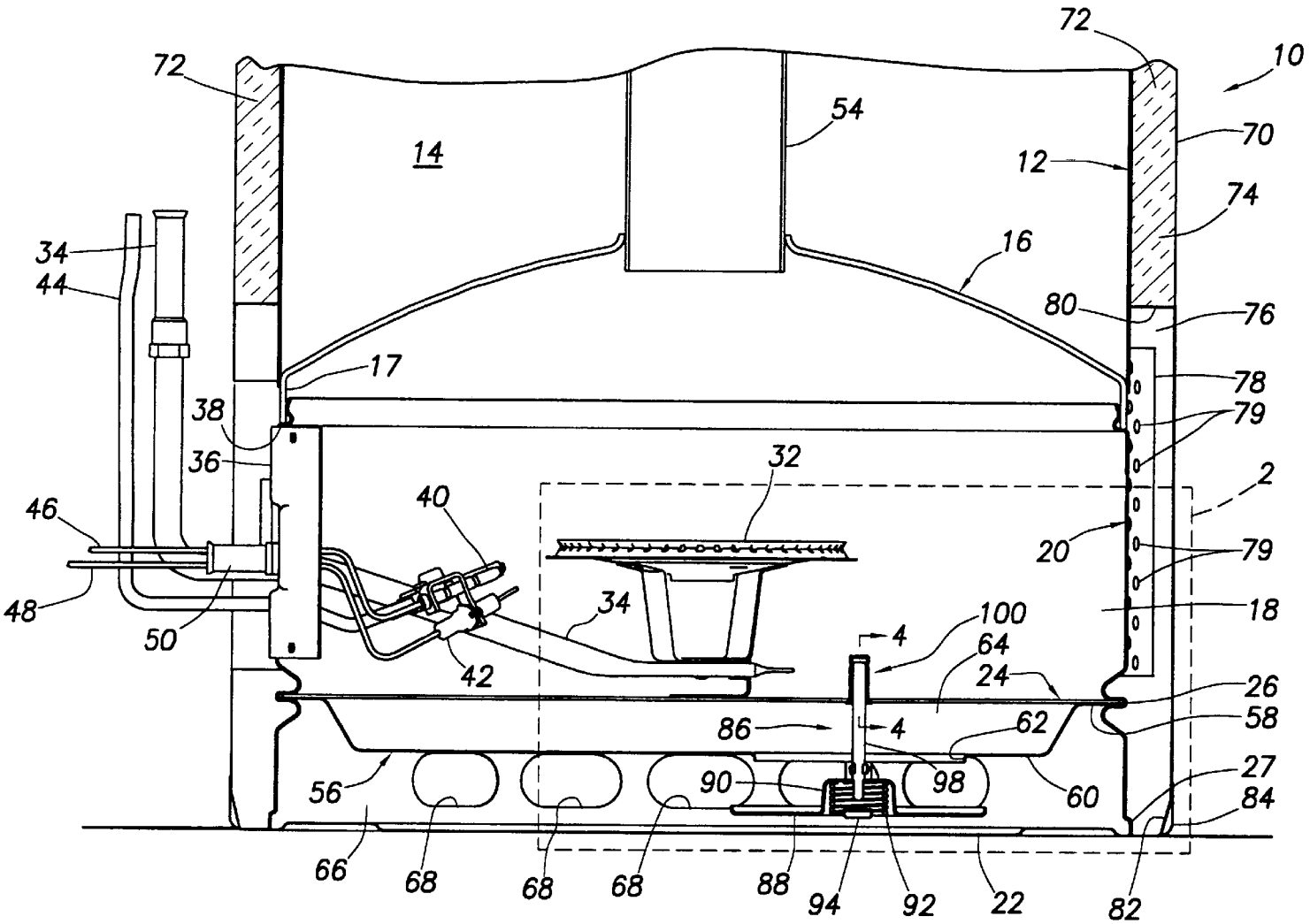
FIG. 1 is a simplified partial cross-sectional view through a bottom portion of a representative gas-fired water heater having incorporated therein a specially designed combustion air shutoff system embodying principles of the present invention.
Figure 2:
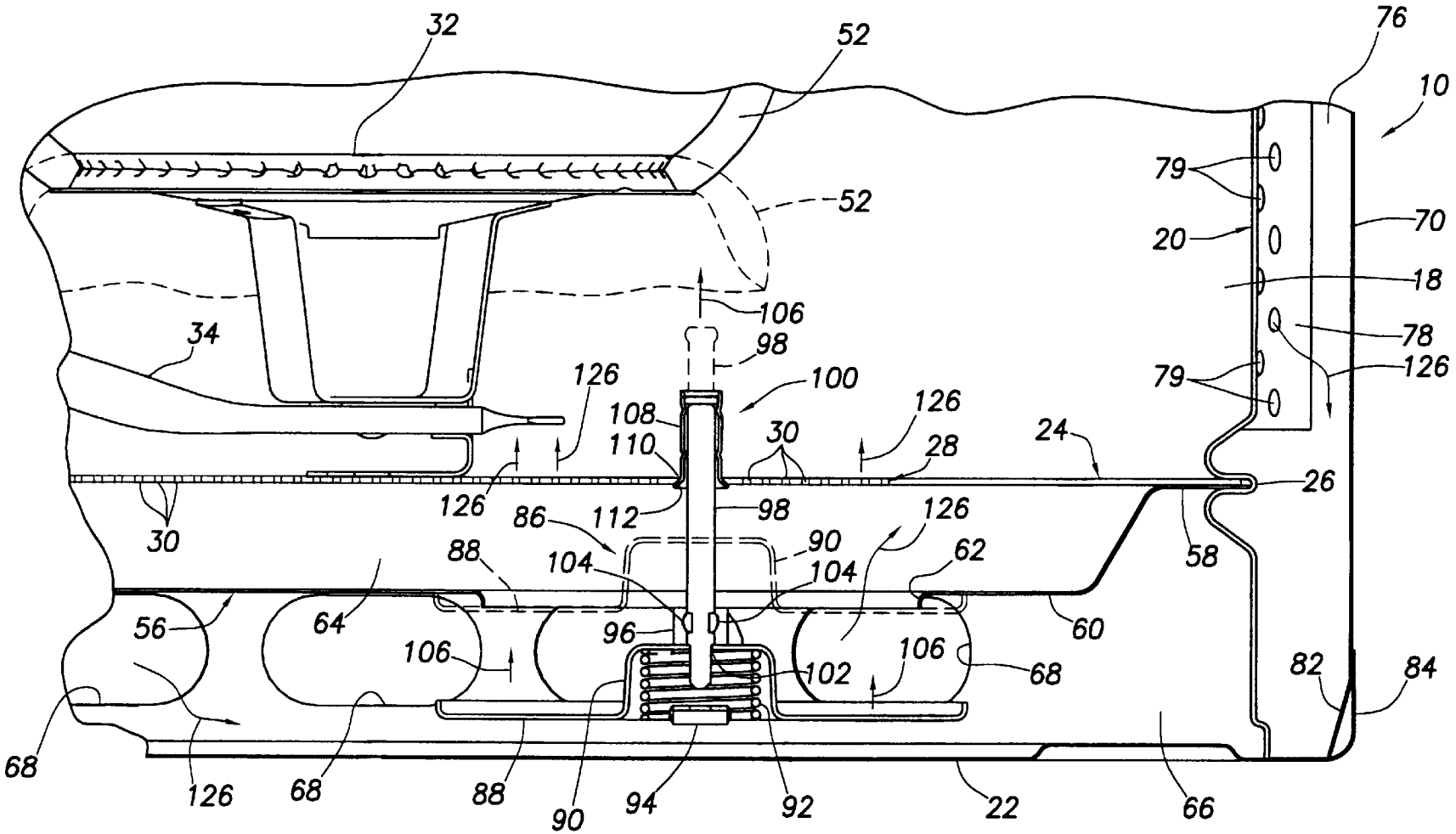
FIG. 2 is an enlargement of the dashed area "2" in FIG. 1 and illustrates the operation of a control damper portion of the combustion air shutoff system.

As illustrated in simplified, somewhat schematic form in FIGS. 1 and 2, in a representative embodiment thereof this invention provides a gas-fired water heater 10 having a vertically oriented cylindrical metal tank 12 adapted to hold a quantity of water 14 to be heated and delivered on demand to one or more hot water-using fixtures, such as sinks, bathtubs, showers, dishwashers and the like. An upwardly domed bottom head structure 16 having an open lower side portion 17 forms a lower end wall of the tank 12 and further defines the top wall of a combustion chamber 18 at the lower end of the tank 12. An annular metal skirt 20 extends downwardly from the periphery of the bottom head 16 to the lower end 22 of the water heater 10 and forms an annular outer side wall portion of the combustion chamber 18. An open upper end portion of the skirt 20 is press-fitted into the lower side portion 17 of the bottom head structure 16, and the closed lower end 27 of the skirt structure 20 downwardly extends to the bottom end 22 of the water heater 10.

Figure 3:
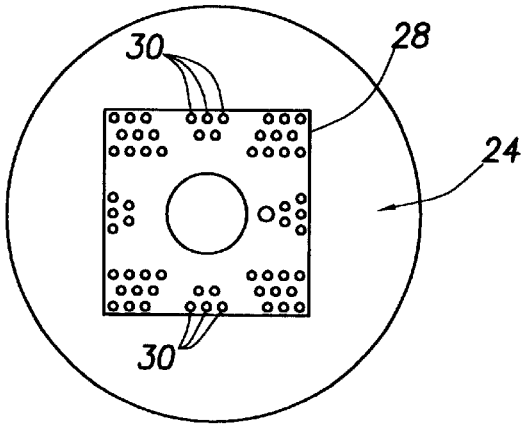
FIG. 3 is a simplified, reduced scale top plan view of an arrestor plate portion of the water heater that forms the bottom wall of its combustion chamber.

The bottom wall of the combustion chamber 18 is defined by a specially designed circular arrestor plate 24 having a peripheral edge portion received and captively retained in an annular roll-formed crimp area 26 of the skirt upwardly spaced apart from its lower end 27. As best illustrated in FIG. 3, the circular arrestor plate 24 has a centrally disposed square perforated area 28 having formed therethrough a spaced series of flame arrestor or flame "quenching" openings 30 which are configured and arranged to permit combustion air and extraneous flammable vapors to flow upwardly into the combustion chamber 18, as later described herein, but substantially preclude the downward travel of combustion chamber flames therethrough. These arrestor plate openings 30 function similarly to the arrestor plate openings illustrated and described in U.S. Pat. No. 6,035,812 to Harrigill et al which is hereby incorporated herein by reference. Illustratively, the metal arrestor plate 24 is 1/16" thick, the arrestor plate openings 30 are 1/16" circular openings, and the center-to-center spacing of the openings 30 is 1/8".

A gas burner 32 is centrally disposed on a bottom interior side portion of the combustion chamber 18. Burner 32 is supplied with gas via a main gas supply pipe 34 (see FIG. 1) that extends into the interior of the combustion chamber 18 through a suitable access door 36 secured over an opening 38 formed in a subsequently described outer sidewall portion of the water heater 10. A conventional pilot burner 40 and associated piezo igniter structure 42 are suitably supported in the interior of the combustion chamber 18, with the pilot burner 40 being supplied with gas via a pilot supply pipe 44 extending inwardly through access door 36. Pilot burner and thermocouple electrical wires 46,48 extend inwardly through a pass-through tube 50 into the combustion chamber interior and are respectively connected to the pilot burner 40 and piezo igniter structure 42.

Burner 32 is operative to create within the combustion chamber 18 a generally upwardly directed flame 52 (as indicated in solid line form in FIG. 2) and resulting hot combustion products. During firing of the water heater 10, the hot combustion products flow upwardly through a flue structure 54 (see FIG. 1) that is connected at its lower end to the bottom head structure 16, communicates with the interior of the combustion chamber 18, and extends upwardly through a central portion of the tank 12. Heat from the upwardly traveling combustion products is transferred to the water 14 to heat it.

Extending beneath and parallel to the arrestor plate 24 is a horizontal damper pan 56 having a circular top side peripheral flange 58 and a bottom side wall 60 having an air inlet opening 62 disposed therein. Bottom side wall 60 is spaced upwardly apart from the bottom end 22 of the water heater 10, and the peripheral flange 58 is captively retained in the roll-crimped area 26 of the skirt 20 beneath the peripheral portion of the arrestor plate 24. The interior of the damper pan 56 defines with the arrestor plate 24 an air inlet plenum 64 that communicates with the combustion chamber 18 via the openings 30 in the arrestor plate 24. Disposed beneath the bottom pan wall 60 is another plenum 66 horizontally circumscribed by a lower end portion of the skirt 20 having a circumferentially spaced series of openings 68 therein.

The outer side periphery of the water heater 10 is defined by an annular metal jacket 70 which is spaced outwardly from the vertical side wall of the tank 12 and defines therewith an annular cavity 72 (see FIG. 1) which is filled with a suitable insulation material 74 down to a point 80 somewhat above the lower side of the bottom head 16. Beneath this point the cavity 72 has an empty portion 76 that extends outwardly around the skirt 20. A pre-filter screen area 78, having a series of air pre-filtering inlet openings 79 therein, is positioned in a lower end portion of the jacket 70, beneath the bottom end 80 of the insulation 74, and communicates the exterior of the water heater 10 with the empty cavity portion 76. Representatively, the screen area 78 is a structure separate from the jacket 70 and is removably secured in a corresponding opening therein. Illustratively, the pre-filter screen area 78 may be of an expanded metal mesh type formed of 3/16" carbon steel in a #22F diamond opening pattern having approximately 55% open area, or could be a metal panel structure having perforations separately formed therein. Alternatively, the openings 79 may be formed directly in the jacket 70. As illustrated in FIGS. 1 and 2, a lower end portion 82 of the jacket 70 is received within a shallow metal bottom pan structure 84 that defines, with its bottom side, the bottom end 22 of the water heater 10.

Water heater 10 incorporates therein a specially designed combustion air shutoff system 86 which, under certain circumstances later described herein, automatically functions to terminate combustion air supply to the combustion chamber 18 via a flow path extending inwardly from the jacket openings 79 to the arrestor plate openings 30. The combustion air shutoff system 86 includes a circular damper plate member 88 that is disposed in the plenum 66 beneath the bottom pan wall opening 62 and has a raised central portion 90. A coiled spring member 92 is disposed within the interior of the raised central portion 90 and is compressed between its upper end and the bottom end 94 of a bracket 96 (see FIG. 2) secured at its top end to the underside of the bottom pan wall 60.

The lower end of a solid cylindrical metal rod portion 98 of a fusible link temperature sensing structure 100 extends downwardly ,into the raised portion 90, through a suitable opening in its upper end. An annular lower end ledge 102 (see FIG. 2) on the rod 98 prevents the balance of the rod 98 from moving downwardly into the interior of the raised damper member portion 90. Just above the ledge 102 (see FIG. 2) are diametrically opposite, radially outwardly extending projections 104 formed on the rod 98. During normal operation of the water heater 10, the damper plate member 88 is held in its solid line position by the rod 98, as shown in FIG. 2, in which the damper plate 88 is downwardly offset from and uncovers the bottom pan wall opening 62, with the spring 92 resiliently biasing the damper plate member 88 upwardly toward the bottom pan wall opening 62. When the fusible link temperature sensing structure 100 is thermally tripped, as later described herein, it permits the spring 92 to upwardly drive the damper plate member 88 to its dotted line closed position (see FIG. 2), as indicated by the arrows 106 in FIG. 2, in which the damper plate member 88 engages the bottom pan wall 60 and closes off the opening 62 therein, thereby terminating further air flow into the combustion chamber 18 as later described herein.

Figure 4:
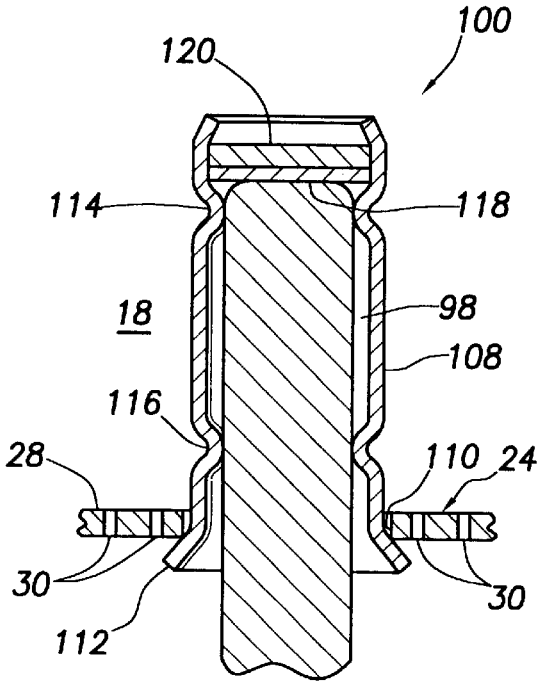
FIG. 4 is an enlarged scale cross-sectional view, taken along line 4—4 of FIG. 1, through a specially designed esthetic temperature sensing structure incorporated in the combustion air shutoff system and projecting into the combustion chamber of the water heater.

Turning now to FIGS. 2 and 4, it can be seen that the temperature sensing structure 100 projects upwardly into the combustion chamber 18 through the perforated square central area 28 of the arrestor plate 24. An upper end portion of the rod 98 is slidably received in a crimped tubular collar member 108 that longitudinally extends upwardly through an opening 110 in the central square perforated portion 28 of the arrestor plate 24 into the interior of the combustion chamber 18, preferably horizontally adjacent a peripheral portion of the gas burner 32. The lower end of the tubular collar 108 is outwardly flared, as at 112, to keep the collar 108 from moving from its FIG. 2 position into the interior of the combustion chamber 18. Above its flared lower end portion 112 the collar has two radially inwardly projecting annular crimps formed therein—an upper crimp 114 adjacent the open upper end of the collar, and a lower crimp 116 adjacent the open lower end of the collar. These crimps serve to guide the rod 98 within the collar 108 to keep the rod from binding therein when it is spring-driven upwardly through the collar 108 as later described herein.

A thin metal disc member 118, having a diameter somewhat greater than the outer diameter of the rod and greater than the inner diameter of the upper annular crimp 114, is slidably received within the open upper end of the collar 108, just above the upper crimp 114, and underlies a meltable disc 120, formed from a suitable esthetic material, which is received in the open upper end of the collar 108 and fused to its interior side surface. The force of the damper spring 92 (see FIG. 2) causes the upper end of the rod 98 to forcibly bear upwardly against the underside of the disc 118, with the unmelted esthetic disc 120 preventing upward movement of the disc 118 away from its FIG. 4 position within the collar 108. When the esthetic disc 120 is melted, as later described herein, the upper end of the rod 98, and the disc 118, are driven by the spring 92 upwardly through the upper end of the collar 108 (as indicated by the dotted line position of the rod 98 shown in FIG. 2) as the damper plate 88 is also spring-driven upwardly to its dotted line closed position shown in FIG. 2.

Figure 4A:
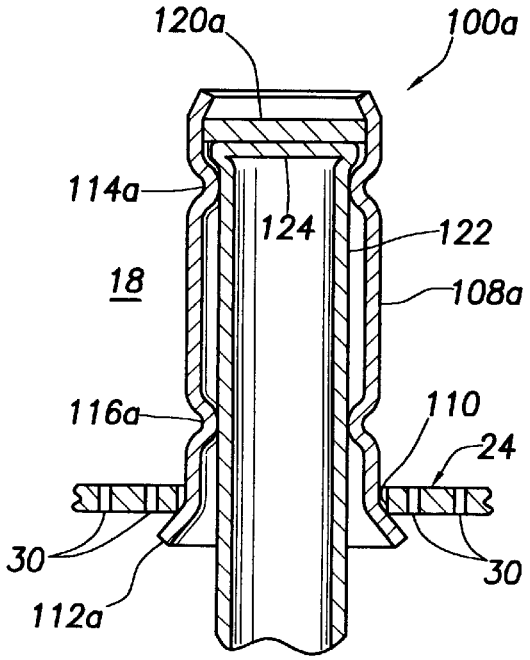
FIG. 4A is a cross-sectional view through a first alternate embodiment of the esthetic temperature sensing structure shown in FIG. 4.

A first alternate embodiment 100*a* of the esthetic temperature sensing structure 100 partially illustrated in FIG. 4 is shown in FIG. 4A. For ease in comparison between the temperature sensing structures 100, 100*a* components in the temperature sensing structure 10*a* similar to those in the temperature sensing structure 100 have been given identical reference numerals with the subscript "a". The esthetic temperature sensing structure 100*a* is substantially identical in operation to the temperature sensing structure 100, but is structurally different in that in the temperature sensing structure 100*a* the solid metal rod 98 is replaced with a hollow tubular metal rod 122, and the separate metal disc 118 is replaced with a laterally enlarged, integral crimped circular upper end portion 124 of the hollow rod 122 that underlies and forcibly bears upwardly against the underside of the esthetic disc 120*a*.

During firing of the water heater 10, ambient combustion air 126 (see FIG. 2) is sequentially drawn inwardly through the openings 79 in the jacket-disposed pre-filter screen area 78 into the empty cavity portion 76, into the plenum 66 via the skirt openings 68, upwardly through the bottom pan wall opening 62 into the plenum 64, and into the combustion chamber 18 via the arrestor plate openings 30 to serve as combustion air for the burner 32.

In the water heater 10, the combustion air shutoff system 86 serves two functions during firing of the water heater. First, in the event that extraneous flammable vapors are drawn into the combustion chamber 18 and begin to burn on the top side of the arrestor plate 24, the temperature in the combustion chamber 18 will rise to a level at which the combustion chamber heat melts the esthetic disc 120 (or the esthetic disc 120*a* as the case may be), thereby permitting the compressed spring 92 to upwardly drive the rod 98 (or the rod 122 as the case may be) through the associated collar 108 or 108*a* until the damper plate member 88 reaches its dashed line closed position shown in FIG. 2 in which the damper plate member 88 closes the bottom pan wall opening 62 and terminates further combustion air delivery to the burner 32 via the combustion air flow path extending from the pre-filter openings 79 to the arrestor plate openings 30. Such termination of combustion air delivery to the combustion chamber shuts down the main and pilot gas burners 32 and 40. As the rod 98 is spring-driven upwardly after the esthetic disc 120 melts (see the dotted line position of the rod 98 in FIG. 2), the lower end projections 104 on the rod 98 prevent it from being shot upwardly through and out of the collar 108 into the combustion chamber 18. Similar projections formed on the alternate hollow rod 122 perform this same function.

The specially designed combustion air shutoff system 86 also serves to terminate burner operation when the esthetic disc 120 (or 120*a*) is exposed to and melted by an elevated combustion chamber temperature indicative of the generation within the combustion chamber 18 of an undesirably high concentration of carbon monoxide created by clogging of the pre-filter screen structure 78 and/or the arrestor plate openings 30. Preferably, the collar portion 108 of the temperature sensing structure 100 is positioned horizontally adjacent a peripheral portion of the main burner 32 (see FIG. 2) so that the burner flame "droop" (see the dotted line position of the main burner flame 52) created by such clogging more quickly melts the esthetic disc 120 (or the esthetic disc 120*a* as the case may be).

Figure 10:
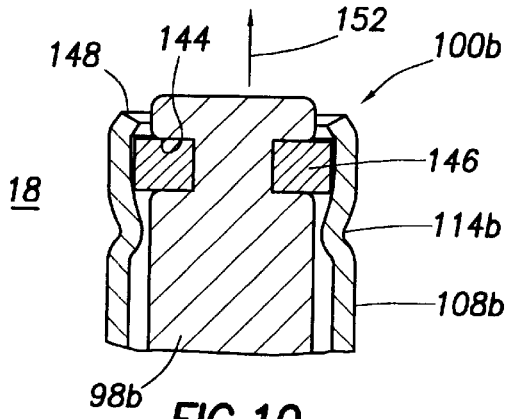
FIG. 10 is a cross-sectional view through an upper end portion of a second alternate embodiment of the esthetic temperature sensing structure shown in FIG. 4.

An upper end portion of a second alternate embodiment 100*b* of the previously described esthetic temperature sensing structure 100 (see FIG. 4) is cross-sectionally illustrated in FIG. 10. For ease in comparison between the temperature sensing structures 100,100*b* components in the temperature sensing structure 100*b* similar to those in the temperature sensing structure 100 have been given identical reference numerals with the subscript "b". The esthetic temperature sensing structure 100*b* is substantially identical in operation to the temperature sensing structure 100, but is structurally different in that in the temperature sensing structure 100*b* the metal rod 98*b* has an annular groove 144 formed in its upper end and receiving an inner edge portion of an annular esthetic alloy member 146.

As illustrated in FIG. 10, an outer annular peripheral edge portion of the esthetic member 146 projects outwardly beyond the side of the rod 98*b* and underlies an annular crimp 148 formed on the upper end of the tubular collar member 108*b*. Crimp 148 overlies and upwardly blocks the outwardly projecting annular edge portion of the esthetic member 146, thereby precluding the rod 98*b* from being spring-driven upwardly past its FIG. 10 position relative to the collar member 108*b*. However, when the esthetic member 146 is melted it no longer precludes such upward movement of the rod 98*b*, and the rod 98*b* is spring-driven upwardly relative to the collar 108*b* as illustrated by the arrow An upper end portion of a third alternate embodiment 100*c* of the previously described esthetic temperature sensing structure 100 (see FIG. 4) is cross-sectionally illustrated in FIG. 11. For ease in comparison between the temperature sensing structures 100,100*c* components in the temperature sensing structure 100*c* similar to those in the temperature sensing structure 100 have been given identical reference numerals with the subscript "c". The esthetic temperature sensing structure 100*c* is substantially identical in operation to the temperature sensing structure 100, but is structurally different in that in the temperature sensing structure 100*c* an annular esthetic alloy member 152 is captively retained between the upper end of the rod 98*c* and the enlarged head portion 154 of a threaded retaining member 156 extended downwardly through the center of the esthetic member 152 and threaded into a suitable opening 158 formed in the upper end of the rod 98*c*.

Figure 11:
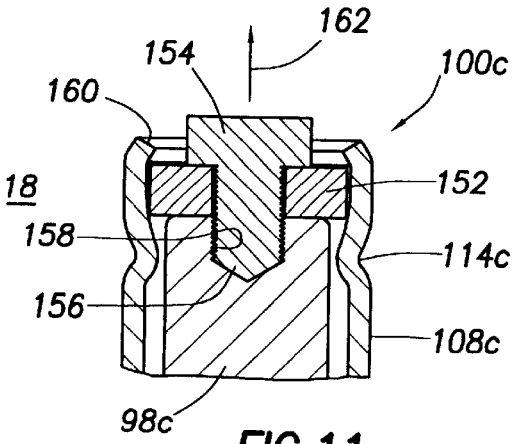
FIG. 11 is a cross-sectional view through an upper end portion of a third alternate embodiment of the esthetic temperature sensing structure shown in FIG. 4.

As illustrated in FIG. 11, an annularly crimped upper end portion 160 of the tubular collar 108*c* upwardly overlies and blocks an annular outer peripheral portion of the esthetic member 152, thereby precluding upward movement of the rod 98*c* and the fastener 156 upwardly beyond their FIG. 11 positions relative to the collar 108*c*. However, when the esthetic member 152 is melted the rod 98*c* and fastener 156 are free to be spring-driven upwardly relative to the collar 108*c* as indicated by the arrow 162 in FIG. 11.

Figure 12:
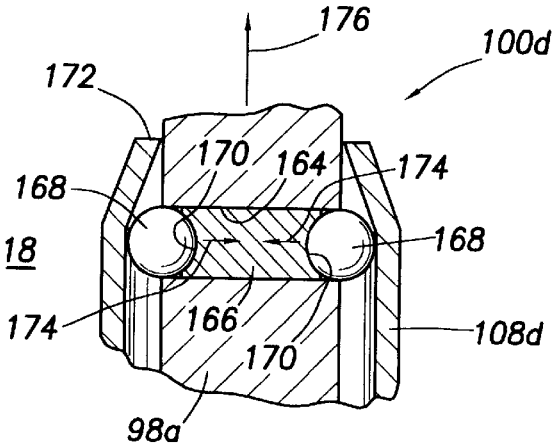
FIG. 12 is a cross-sectional view through an upper end portion of a fourth alternate embodiment of the esthetic temperature sensing structure shown in FIG. 4.
Figure 14:
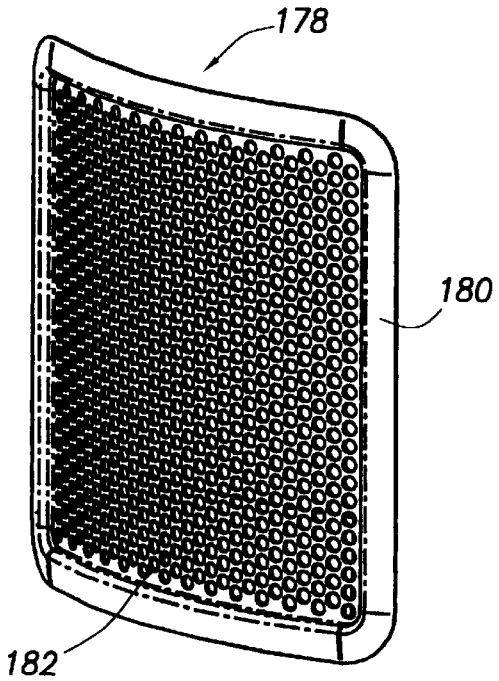
FIG. 14 is an enlarged scale outer side perspective view of a molded plastic snap-in combustion air pre-filter structure incorporated in the FIG. 13 water heater.

An upper end portion of a fourth alternate embodiment 100*d* of the previously described esthetic temperature sensing structure 100 (see FIG. 4) is cross-sectionally illustrated in FIG. 12. For ease in comparison between the temperature sensing structures 100,100*d* components in the temperature sensing structure 100*dc* similar to those in the temperature sensing structure 100 have been given identical reference numerals with the subscript "d". The esthetic temperature sensing structure 100*dc* is substantially identical in operation to the temperature sensing structure 100, but is structurally different in that a transverse circular bore 164 is formed through the rod 98*d* adjacent its upper end, the bore 164 complementarily receiving a cylindrical esthetic alloy member 166.

A pair of metal balls 168, each sized to move through the interior of the bore 164, partially extend into the opposite ends of the bore 164 and are received in partially spherical indentations 170 formed in the opposite ends of the esthetic member 166. An annular crimped upper end portion 172 of the collar 108*d* upwardly overlies and blocks the portions of the balls 168 that project outwardly beyond the side of the rod 98*a*, thereby precluding upward movement of the rod 98*d* from its FIG. 12 position relative to the collar 108*d*. However, when the esthetic member 166 is melted, the upward spring force on the rod 98*d* causes the crimped area 172 to force the balls 168 toward one another through the bore 164, as indicated by the arrows 174 in FIG. 12, thereby permitting the rod 98*d* to be upwardly driven from its FIG. 12 position relative to the collar 108*d* as illustrated by the arrow 176 in FIG. 12.

According to another feature of the present invention, (1) the opening area-to-total area ratios of the pre-filter screen structure 78 and the arrestor plate 24, (2) the ratio of the total open area in the pre-filter screen structure 78 to the total open area in the arrestor plate 24, and (3) the melting point of the esthetic material 120 (or 120*a*,146,152 or 166 as the case may be) are correlated in a manner such that the rising combustion temperature in the combustion chamber 18 caused by a progressively greater clogging of the pre-filter openings 79 and the arrestor plate openings 30 (by, for example, airborne material such as lint) melts the esthetic material 120 and trips the temperature sensing structure 100 and corresponding air shutoff damper closure before a predetermined maximum carbon monoxide concentration level (representatively about 200–400 ppm by volume) is reached within the combustion chamber 18 due to a reduced flow of combustion air into the combustion chamber. The pre-filter area 78 and the array of arrestor plate openings 30 are also sized so that some particulate matter is allowed to pass through the pre-filter area and come to rest on the arrestor plate. This relative sizing assures that combustion air will normally flow inwardly through the pre-filter area as opposed to being blocked by particulate matter trapped only by the pre-filter area.

In developing the present invention it has been found that a preferred "matching" of the pre-filter structure to the perforated arrestor plate area, which facilitates the burner shutoff before an undesirable concentration of CO is generated within the combustion chamber 18 during firing of the burner 32, is achieved when (1) the ratio of the open area-to-total area percentage of the pre-filter structure 78 to the open area-to-total area percentage of the arrestor plate 24 is within the range of from about 1.2 to about 2.5, and (2) the ratio of the total open area of the pre-filter structure 78 to the total open area of the arrestor plate 24 is within the range of from about 2.5 to about 5.3. The melting point of the esthetic portion of the temperature sensing structure 100 may, of course, be appropriately correlated to the determinable relationship in a given water heater among the operational combustion chamber temperature, the quantity of combustion air being flowed into the combustion chamber, and the ppm concentration level of carbon monoxide being generated within the combustion chamber during firing of the burner 32.

By way of illustration and example only, the water heater 10 illustrated in FIGS. 1 and 2 representatively has a tank capacity of 50 gallons of water; an arrestor plate diameter of 20 inches; and a burner firing rate of between 40,000 and 45,000 BTUH. The total area of the square perforated arrestor plate section 28 (see FIG. 3) is 118.4 square inches, and the actual flow area defined by the perforations 30 in the square area 28 is 26.8 square inches. The overall area of the jacket pre-filter structure 78 is 234 square inches, and the actual flow area defined by the openings in the structure 78 is 119.4 square inches. The ratio of the hydraulic diameter of the arrestor openings 30 to the thickness of the arrestor plate 24 is within the range of from about 0.75 to about 1.25, and is preferably about 1.0, and the melting point of the esthetic material in the temperature sensing structure 100 is within the range of from about 425 degrees F. to about 465 degrees F., and is preferably about 430 degrees F.

Cross-sectionally illustrated in simplified form in FIG. 9, is a bottom side portion of a first alternate embodiment 10*a* of the previously described gas-fired water heater 10. For ease in comparing the water heater embodiments 10 and 10*a*, components in the embodiment 10*a* similar to those in the embodiment 10 have been given the same reference numerals, but with the subscripts "a".

The water heater 10*a* is identical to the previously described water heater 10 with the exceptions that in the water heater 10*a* (1) the pre-filter screen area 78 carried by the jacket 70 in the water heater 10 is eliminated and replaced by a subsequently described structure, (2) the lower end 82*a* of the jacket 70 *a* is disposed just below the bottom end 80*a* of the insulation 74*a* instead of extending clear down to the bottom end 22*a* of the water heater 10*a*, and (3) the shallow bottom pan 84 utilized in the water heater 10 is replaced in the water heater 10*a* with a considerably deeper bottom jacket pan 128 which is illustrated in FIGS. 5–8.

Bottom jacket pan 128 is representatively of a one piece molded plastic construction (but could be of a different material and/or construction if desired) and has an annular vertical sidewall portion 130, a solid circular bottom wall 132, and an open upper end bordered by an upwardly opening annular groove 134 (see FIGS. 8 and 9). Formed in the sidewall portion 130 are (1) a bottom drain fitting 136, (2) a burner access opening 138 (which takes the place of the access opening 38 in the water heater 10), (3) a series of pre-filter air inlet openings 140 (which take the place of the pre-filter openings 79 in the water heater 10), and (4) a holder structure 142 for a depressible button portion (not shown) of a piezo igniter structure associated with the main burner portion of the water heater 1*a*.

As best illustrated in FIG. 9, the annular skirt 20*a* extends downwardly through the interior of the pan 128, with the bottom skirt end 27*a* resting on the bottom pan wall 132, and the now much higher annular lower end 82*a* of the jacket 70 *a* being closely received in the annular groove 134 extending around the top end of the pan structure 128. The use of this specially designed one piece bottom jacket pan 128 desirably reduces the overall cost of the water heater 10*a* and simplifies its construction.

Figure 13:
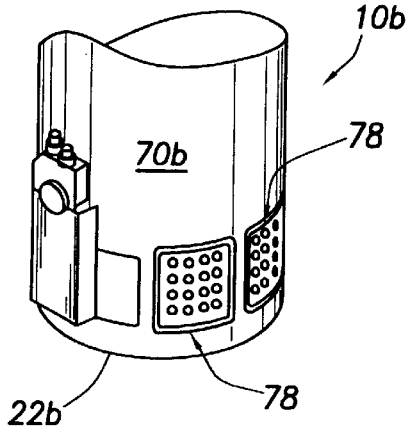
FIG. 13 is a simplified perspective view of a bottom end portion of a second embodiment of the FIG. 1 water heater.

Perspectively illustrated in simplified form in FIG. 13 is a bottom end portion of a second alternate embodiment 10*b* of the previously described gas-fired water heater 10. For ease in comparing the water heater embodiments 10 and 10*b*, components in the embodiment 10*b* similar to those in the embodiment 10 have been given the same reference numerals, but with the subscripts "b".

The water heater 10*b* is identical to the previously described water heater 10 with the exception that in the water heater 10*b* the previously described pre-filter screen area 78 carried by the jacket 70 in the water heater 10 (see FIGS. 1 and 2) is eliminated and replaced by a circumferentially spaced series of specially designed, molded plastic perforated pre-filtering panels 178 which are removably snapped into corresponding openings in a lower end portion of the outer jacket structure 70*b* of the water heater 10*b*.

Figure 15:
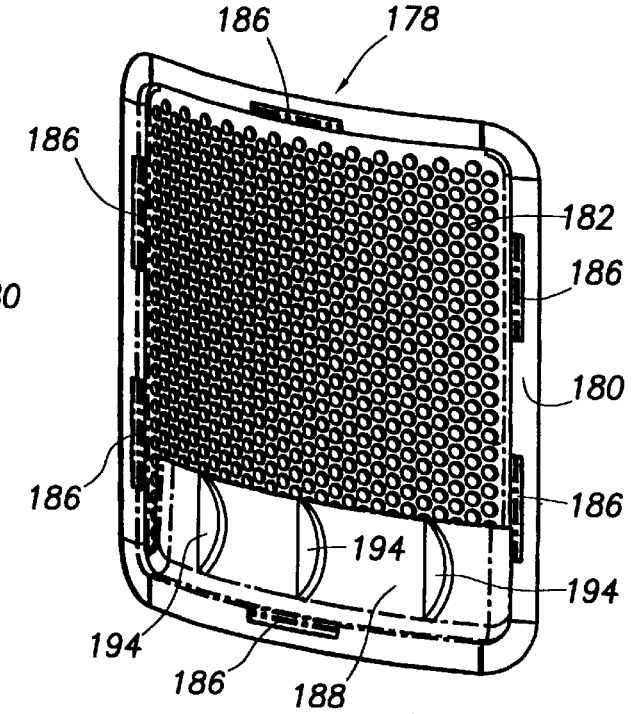
FIG. 15 is an inner side perspective view of the molded plastic pre-filter structure.
Figure 16:
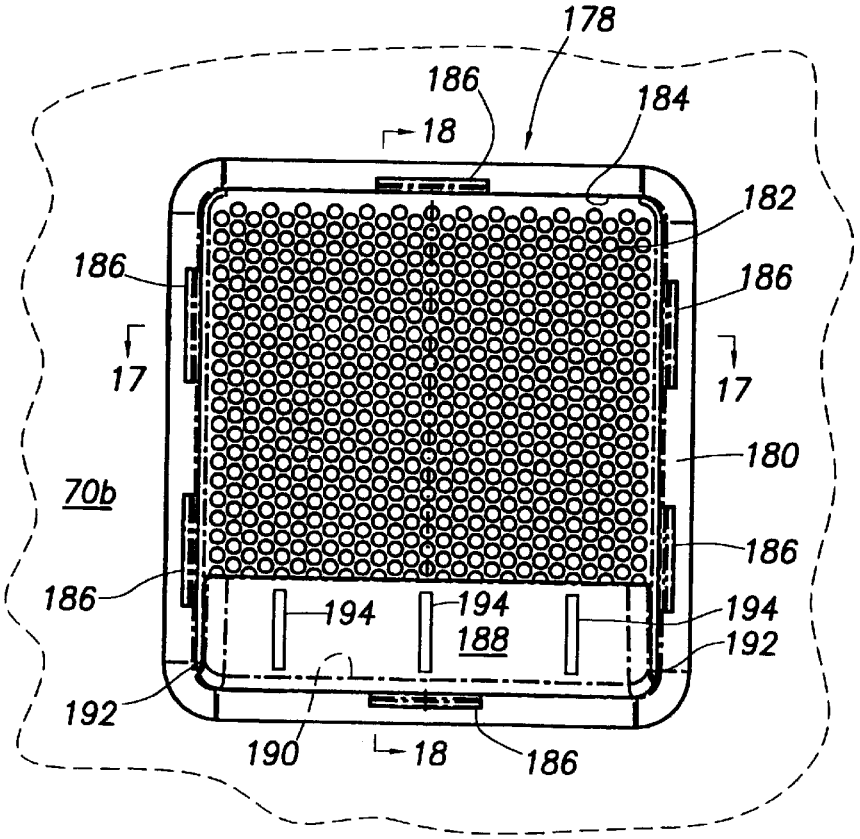
FIG. 16 is an inner side elevational view of the molded plastic pre-filter structure operatively installed in the FIG. 13 water heater.
Figure 17:
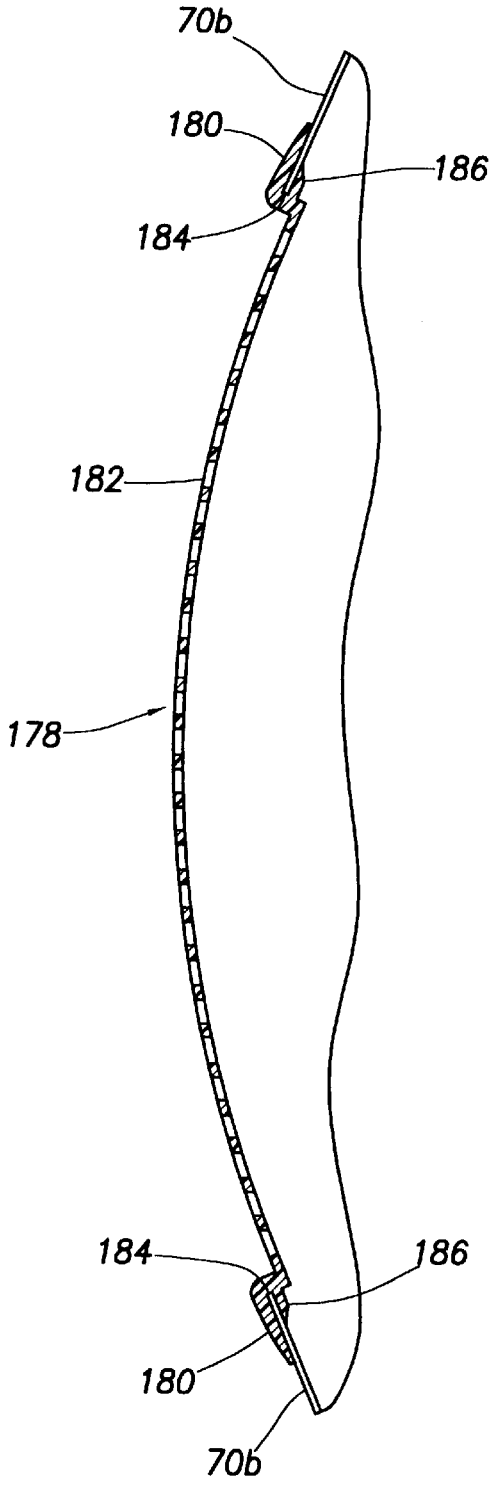
FIG. 17 is an enlarged cross-sectional view through the molded plastic pre-filter structure taken along line 17—17 of FIG. 16.
Figure 18:
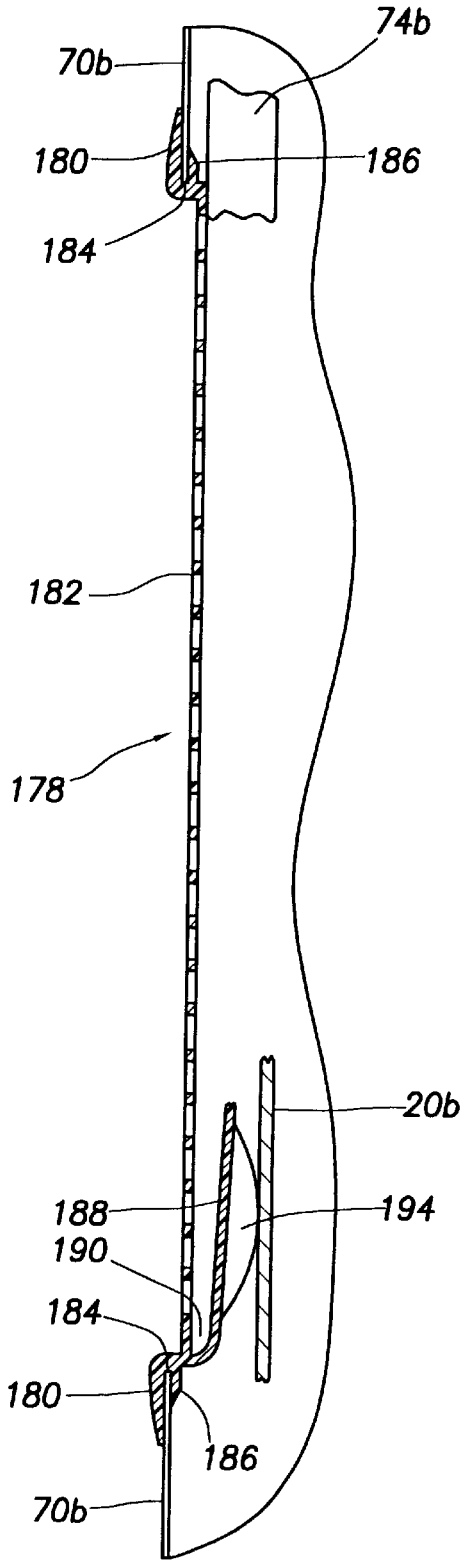
FIG. 18 is an enlarged cross-sectional view through the molded plastic pre-filter structure taken along line 18—18 of FIG. 16.

With reference now to FIGS. 14–18, each of the molded plastic perforated pre-filter panels 178 has a rectangular frame 180 that borders a rectangular, horizontally curved perforated air pre-filtering plate 182. Each panel 178 may be removably snapped into a corresponding rectangular opening 184 (see FIGS. 16–18) using resiliently deflectable retaining tabs 186 formed on the inner side of the frame 180 and adapter to inwardly overlie the jacket 70*b* at spaced locations around the periphery of the jacket opening 184 as shown in FIGS. 16–18.

Formed on a bottom end portion of the inner side of each frame 180 is an upstanding shield plate 188 which is inwardly spaced apart from the frame 180 and forms with a bottom side portion thereof a horizontally extending trough 190 (see FIGS. 16 and 18) having opposite open ends 192 (see FIGS. 15 and 16). As illustrated in FIGS. 15, 16 and 18, a horizontally spaced plurality of reinforcing tabs 194 project outwardly from the inner side of the shield plate 188.

As illustrated in FIG. 18, a top end portion of each installed pre-filter panel 178 contacts an inwardly adjacent portion of the overall insulation structure 74*b*, thereby bracing a portion of the jacket 70*b* against undesirable inward deflection adjacent the upper end of opening 184. At the bottom end of each installed pre-filter panel 178, the arcuate outer side edges of the reinforcing tabs 194 are normally spaced slightly outwardly from the skirt structure 20*b*. However, if a bottom end portion of the panel 178 and an adjacent portion of the jacket 70*b* are deflected inwardly toward the skirt structure 20*b*, the tabs 194 (as shown in FIG. 18) are brought to bear against the skirt structure 20*b* and serve to brace and reinforce the adjacent portion of the jacket 70*b* against further inward deflection thereof.

The shield plate portion 188 of each pre-filter panel 178 uniquely functions to prevent liquid splashed against a lower outer side portion of the installed panel 178 from simply traveling through the plate perforations and coming into contact with the skirt 20*b* and the air inlet openings therein. Instead, such splashed liquid comes into contact with the outer side of the shield plate 188, drains downwardly therealong into the trough 190, and spills out of the open trough ends 192 without coming into contact with the skirt 194.

While principles of the present invention have been illustrated and described herein as being representatively incorporated in a gas-fired s water heater, it will readily be appreciated by those skilled in this particular art that such principles could also be employed to advantage in other types of fuel-fired heating appliances such as, for example, boilers and other types of fuel-fired water heaters. Additionally, while a particular type of combustion air inlet flow path has been representatively illustrated and described in conjunction with the water heater 10, 10*a* and 10*b*, it will also be readily appreciated by those skilled in this art that various other air inlet path and shutoff structure configurations could be utilized, if desired, to carry out the same general principles of the present invention.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber thermally communicatable with a fluid to be heated;

a burner structure associated with said combustion chamber and operative to receive fuel from a source thereof;

a wall structure defining a flow path through which combustion air may flow into said combustion chamber for mixture and combustion with fuel received by said burner structure to create hot combustion products within said combustion chamber; and a combustion air shutoff system operative to sense the temperature in said combustion chamber and responsively prevent combustion air supply to said combustion chamber via said flow path in response to said temperature reaching a level correlated to and indicative of a predetermined, undesirably high concentration of carbon monoxide present in said combustion chamber and created by a reduction in the quantity of combustion air entering said combustion chamber via said flow path.

2. The fuel-fired heating apparatus of claim 1 wherein:

said fuel-fired heating apparatus is a gas-fired water heater.

3. The fuel-fired heating apparatus of claim 1 wherein said combustion air shutoff system includes:

a temperature sensing structure extending into the interior of said combustion chamber.

4. The fuel-fired heating apparatus of claim 3 wherein:

said burner structure is disposed within said combustion chamber, and said temperature sensing structure is positioned adjacent said burner structure.

5. The fuel-fired heating apparatus of claim 3 wherein said temperature sensing structure includes:

a collar structure axially projecting into said combustion chamber, a rod coaxially received in said collar structure for longitudinal movement therethrough, and a esthetic structure releasably preventing movement of said rod through said collar into said combustion chamber.

6. The fuel-fired heating apparatus of claim 5 wherein:

said combustion chamber has an outer wall with an opening therein, said collar structure extends inwardly through said opening into the interior of said combustion chamber, and said collar structure has a laterally enlarged outer end portion disposed externally of said outer wall and blocking entry of said outer end portion of said collar into the interior of said combustion chamber.

7. The fuel-fired heating apparatus of claim 5 wherein:

said collar structure has an inner end disposed within said combustion chamber, said rod has an inner end disposed within said collar structure, and said esthetic structure includes a quantity of esthetic material positioned within said collar structure between said inner end of said collar structure and said inner end of said rod and, until melted, blocking movement of said rod inwardly through said collar structure.

8. The fuel-fired heating apparatus of claim 7 wherein said esthetic structure further comprises:

a disc disposed in said collar structure and interposed between said esthetic material and said inner end of said rod.

9. The fuel-fired heating apparatus of claim 7 wherein:

said rod is of a solid construction.

10. The fuel-fired heating apparatus of claim 7 wherein:

said inner end of said rod is laterally enlarged and bears directly against said esthetic material.

11. The fuel-fired heating apparatus of claim 10 wherein:

said rod is of a hollow construction.

12. The fuel-fired heating apparatus of claim 5 wherein:

said rod has an annular exterior side surface groove formed therein, said esthetic structure is an annular esthetic member having an annular inner side portion received in said groove, and an annular outer side portion projecting laterally outwardly from the side Of said rod, and said collar structure has a portion overlying and blocking said annular outer side portion Of said esthetic member in a manner precluding movement of said rod through said collar structure an into said combustion chamber until said esthetic member is melted.

13. The fuel-fired heating apparatus of claim 5 wherein:

said rod has an inner end disposed in said collar structure, said esthetic structure is held against said inner end by a fastening member, and has an outer portion projecting outwardly from the side of said rod, and said collar structure has a portion overlying and blocking said outer portion of said esthetic structure in a manner-precluding movement of said rod through said collar structure and into said combustion chamber until said esthetic structure is melted.

14. The fuel-fired heating apparatus of claim 5 wherein:

said rod has an inner end disposed in said collar structure and having a transverse bore extending therethrough, said esthetic structure comprises a esthetic material received in said bore, said temperature sensing structure further includes first and second members extending into opposite ends of said bore into contact with said esthetic structure, said first and second members having outer portions extending outwardly from said opposite ends of said bore, said first and second members being blocked from further movement into said bore by said esthetic structure, but being movable further into said bore upon melting of said esthetic structure, and said collar structure has a portion overlying and blocking said outer portion of said first and second members in a manner precluding movement of said rod through said collar structure and into sad combustion chamber until melting of said esthetic structure permits further movement of said first and second members into said bore.

15. The fuel-fired heating apparatus of claim 14 wherein:

said first and second members have spherical configurations.

16. The fuel-fired heating apparatus of claim 5 wherein:

said combustion air shutoff system further includes a damper disposed externally of said combustion chamber and being movable between an open position in which said damper permits combustion air to flow into said combustion chamber via said flow path, and a closed position in which said damper precludes combustion air flow into said combustion chamber via said flow path, said damper being resiliently biased toward said closed position and releasably held in said open position by said rod.

17. The fuel-fired heating apparatus of claim 1 wherein:

said combustion chamber has an outer wall with a first perforated area therein, said wall structure has a second perforated area spaced apart from said first perforated area, said flow path extends from said second perforated area to said first perforated area, combustion air operatively traversing said flow path during firing of said burner structure sequentially flows through said second perforated area and said first perforated area, and said second perforated area is operative to only partially pre-filter combustion air flowing inwardly therethrough into said flow path.

18. The fuel-fired heating apparatus of claim 17 wherein:

the wall openings in said first perforated area are flame quenching openings.

19. The fuel-fired heating apparatus of claim 18 wherein:

said outer wall of said combustion chamber is a circular arrestor plate, and said first perforated area has a rectangular configuration and is centrally disposed on said arrestor plate.

20. The fuel-fired heating apparatus of claim 19 wherein:

said first perforated area has a square configuration.

21. The fuel-fired heating apparatus of claim 17 wherein:

the ratio of the open area-to-total area percentage of said second perforated area to the open area-to-total area percentage of said first perforated area is in the range of from about 1.2 to about 2.5.

22. The fuel-fired heating apparatus of claim 21 wherein:

the ratio of the total open area of said second perforated area to the total open area of said first perforated area is in the range of from about 2.5 to about 5.3.

23. The fuel-fired heating apparatus of claim 17 wherein:

the ratio of the total open area of said second perforated area to the total open area of said first perforated area is in the range of from about 2.5 to about 5.3.

24. The fuel-fired heating apparatus of claim 17 wherein:

said heating apparatus is a water heater having an outer jacket structure on which said second perforated area is disposed.

25. The fuel-fired heating apparatus of claim 24 wherein:

said outer jacket structure has a opening therein, and and said second perforated area is formed in a separate section removably received in said outer jacket structure opening.

26. The fuel-fired heating apparatus of claim 25 wherein:

said separate section is a perforated panel structure releasably snap-fittable into said outer jacket structure opening.

27. The fuel-fired heating apparatus of claim 26 wherein:

said perforated panel structure is a one piece plastic molding.

28. The fuel-fired heating apparatus of claim 26 wherein:

said water heater has an inner portion disposed inwardly apart from said outer jacket structure opening, and said perforated panel structure has an inwardly projecting reinforcing portion adapted to be brought into engagement with said inner water heater portion and brace a portion of said outer jacket structure in a manner limiting inward deflection thereof.

29. The fuel-fired heating apparatus of claim 26 wherein:

said perforated panel structure has a body portion with an inner side having a shield wall extending generally parallel to said body portion, in an inwardly spaced relationship therewith, and forming therewith along a bottom portion of said shield wall a trough for receiving liquid inwardly passing through a portion of said perforated panel structure.

30. The fuel-fired heating apparatus of claim 29 wherein:

said perforated panel structure further includes a spaced series of reinforcing projections carried on said shield wall and adapted to be brought into engagement with a portion of said water heater disposed inwardly of said outer jacket structure opening and brace a portion of said outer jacket structure in a manner limiting inward deflection thereof.

31. The fuel-fired heating apparatus of claim 1 wherein:

said predetermined elevated concentration of carbon monoxide is in the range of from about 200 ppm to about 400 ppm by volume.

32. The fuel-fired heating apparatus of claim 1 wherein said fuel-fired heating apparatus is a water heater having:

a lower end, an outer jacket structure having a bottom end edge spaced upwardly apart from said lower end, and a bottom jacket pan having an open upper end with a circumferential groove receiving said bottom end edge of said outer jacket structure, a bottom wall forming said lower end of said water heater, and a vertical side wall extending between said bottom wall and said groove and having formed therein a perforated area defining an inlet air pre-filtering portion of said flow path.

33. The fuel-fired heating apparatus of claim 32 wherein:

said bottom jacket pan is of a one piece molded plastic construction.

34. The fuel-fired heating apparatus of claim 32 wherein:

said bottom jacket pan has a burner access opening formed in said side wall.

35. The fuel-fired heating apparatus of claim 32 wherein:

said bottom jacket pan has a drain fitting carried by said side wall adjacent said bottom wall.

36. The fuel-fired heating apparatus of claim 32 wherein:

said bottom jacket pan has a mounting structure disposed on said side wall and operative to support an actuating portion of a piezo igniter structure.

37. The fuel-fired heating apparatus of claim 1 wherein:

said combustion chamber has an arrestor wall with a spaced series of flame quenching combustion air inlet openings extending therethrough, said combustion air inlet openings having hydraulic diameters, and said arrestor wall having a thickness, and the ratio of said hydraulic diameters to said thickness is in the range of from about 0.75 to about 1.25.

38. The fuel-fired heating apparatus of claim 37 wherein:

said ratio is approximately 1.0.

39. A method of operating a fuel-fired heating apparatus having a combustion chamber, a burner structure operative to create hot combustion products in said combustion chamber, and a flow path external to said combustion chamber and operative to deliver combustion air into said combustion chamber, said method comprising the steps of sensing in said combustion chamber an elevated combustion temperature correlated to and indicative of a predetermined, undesirably high concentration of carbon monoxide in said combustion chamber, created by a reduction in air flow through said flow path into said combustion chamber, and responsively preventing combustion air flow through said flow path.

40. The method of claim 39 wherein:

said sensing step is performed using a esthetic temperature sensing structure.

41. The method of claim 40 wherein:

said sensing step is performed using a esthetic temperature sensing structure that projects into the interior of said combustion chamber.

42. The method of claim 41 wherein:

said temperature sensing structure has a set point temperature, and said step of responsively terminating combustion air flow through said flow path is performed using a spring-loaded damper member held in an open orientation by said temperature sensing structure until said set point temperature is reached within said combustion chamber.

43. The method of claim 39 further comprising the step of:

causing said flow path to extend between a perforated combustion air pre-filtering structure external to said combustion chamber, and a perforated external wall portion of said combustion chamber.

44. The method of claim 43 further comprising the step of:

disposing said perforated combustion air pre-filtering structure in an external wall portion of said fuel-fired heating apparatus.

45. The method of claim 44 further comprising the step of:

correlating said perforated pre-filtering structure and said perforated external combustion chamber wall portion in a manner such that the ratio of the open area-to-total area percentage of said perforated pre-filtering structure to the open area-to-total area percentage of said perforated external wall portion of said combustion chamber is in the range of from about 1.2 to about 2.5.

46. The method of claim 44 further comprising the step of:

correlating said perforated pre-filtering structure and said perforated external combustion chamber wall portion in a manner such that the ratio of the total open area of said perforated pre-filtering structure and said perforated external wall portion of said combustion chamber is in the range of from about 2.5 to about 5.3.

47. The method of claim 46 further comprising the step of:

correlating said perforated pre-filtering structure and said perforated external combustion chamber wall portion in a manner such that the ratio of the total open area of said perforated pre-filtering structure and said perforated external wall portion of said combustion chamber is in the range of from about 2.5 to about 5.3.

48. Fuel-fired heating apparatus comprising:

a combustion chamber thermally communicatable with a fluid to be heated, said combustion chamber having an outer wall defined by an arrestor plate having a perforated portion defined by flame quenching openings formed in said arrestor plate;

a burner structure disposed in said combustion chamber and operative to receive fuel from a source thereof;

a wall structure defining a flow path external to said combustion chamber and through which combustion air may flow into said combustion chamber for mixture and combustion with fuel received by said burner structure to create hot combustion products within said combustion chamber;

a damper structure disposed externally of said combustion chamber and being resiliently biased toward a closed position in which it terminates air flow through said flow path; and a temperature sensing structure projecting into said combustion chamber, releasably blocking said damper structure in an open position in which it permits combustion air to flow through said flow path into said combustion chamber, and being operative to unblock said damper structure, and permit it to be driven to its closed position, in response to the presence of a predetermined, undesirably high temperature in said combustion chamber during firing of said burner structure.

49. The fuel-fired heating apparatus of claim 48 wherein said fuel-fired heating apparatus is a gas-fired water heater.

50. The fuel-fired heating apparatus of claim 49 wherein:

said temperature sensing structure extends through said perforated area of said arrestor plate.

51. The fuel-fired heating apparatus of claim 50 wherein:

said temperature sensing structure is a fusible link structure.

52. The fuel-fired heating apparatus of claim 48 wherein said temperature sensing structure includes:

a collar structure axially projecting into said combustion chamber, a rod coaxially received in sad collar structure for longitudinal movement therethrough, said rod engaging said damper structure and releasably blocking it against movement toward said closed position, and a esthetic structure releasably preventing movement of said rod through said collar structure into said combustion chamber.

53. The fuel-fired heating apparatus of claim 52 wherein:

said arrestor plate has an opening therein, said collar extends inwardly through said opening into the interior of said combustion chamber, and said collar has a laterally enlarged outer end portion disposed externally of said arrestor plate and blocking entry of said outer end portion of said collar into the interior of said combustion chamber.

54. The fuel-fired heating apparatus of claim 52 wherein:

said collar has an inner end disposed within said combustion chamber, said rod has an inner end disposed within said collar, and said esthetic structure includes a quantity of esthetic material positioned within said collar between said inner end of said collar and said inner end of said rod and, until melted, blocking movement of said rod inwardly through said collar.

55. The fuel-fired heating apparatus of claim 54 wherein said esthetic structure further comprises:

a disc slidably disposed in said collar and interposed between said esthetic material and said inner end of said rod.

56. The fuel-fired heating apparatus of claim 54 wherein:

said rod is of a solid construction.

57. The fuel-fired heating apparatus of claim 54 wherein:

said inner end of said rod is laterally enlarged and bears directly against said esthetic material.

58. The fuel-fired heating apparatus of claim 57 wherein:

said rod is of a hollow construction.

59. The fuel-fired heating apparatus of claim 52 wherein:

said rod has an annular exterior side surface groove formed therein, said esthetic structure is an annular esthetic member having an annular inner side portion received in said groove, and an annular outer side portion projecting laterally outwardly from the side of said rod, and said collar structure has a portion overlying and blocking said annular outer side portion of said esthetic member in a manner precluding movement of said rod through said collar structure and into said combustion chamber until said esthetic member is melted.

60. The fuel-fired heating apparatus of claim 52 wherein:

said rod has an inner end disposed in said collar structure, said esthetic structure is held against said inner end by a fastening member, and has an outer portion projecting outwardly from the side of said rod, and said collar structure has a portion overlying and blocking said outer portion of said esthetic structure in a manner precluding movement of said rod through said collar structure and into said combustion chamber until said esthetic structure is melted.

61. The fuel-fired heating apparatus of claim 52 wherein:

said rod has an inner end disposed in said collar structure and having a transverse bore extending therethrough, said esthetic structure comprises a esthetic material received in said bore, said temperature sensing structure further includes first and second members extending into opposite ends of said bore into contact with said esthetic structure, said first and second members having outer portions extending outwardly from said opposite ends of said bore, said first and second members being blocked from further movement into said bore by said esthetic structure, but being movable further into said bore upon melting of said esthetic structure, and said collar structure has a portion overlying and blocking said outer portion of said first and second members in a manner precluding movement of said rod through said collar structure and into said combustion chamber until melting of said esthetic structure permits further movement of said first and second members into said bore.

62. The fuel-fired heating apparatus of claim 61 wherein:

said first and second members have spherical configurations.

63. The fuel-fired heating apparatus of claim 48 wherein said fuel-fired heating apparatus is a water heater having:

a lower end, an outer jacket structure having a bottom end edge spaced upwardly apart from said lower end, and a bottom jacket pan having an open upper end with a circumferential groove receiving said bottom end edge of said outer jacket structure, a bottom wall forming said lower end of said water heater, and a vertical side wall extending between said bottom wall and said groove and having formed therein a perforated area defining an inlet air pre-filtering portion of said flow path.

64. The fuel-fired heating apparatus of claim 63 wherein:

said bottom jacket pan is of a one piece molded plastic construction.

65. The fuel-fired heating apparatus of claim 63 wherein:

said bottom jacket pan has a burner access opening formed in said side wall.

66. The fuel-fired heating apparatus of claim 63 wherein:

said bottom jacket pan has a drain fitting carried by said side wall adjacent said bottom wall.

67. The fuel-fired heating apparatus of claim 63 wherein:

said bottom jacket pan has a mounting structure disposed on said side wall and operative to support an actuating portion of a piezo igniter structure.

* * * * *

UNITED STATES PATENT AND TRADEMARK OFFICE

CERTIFICATE OF CORRECTION

PATENT NO. : 6,497,200 B2
DATED : December 24, 2002
INVENTOR(S) : Gordon W. Stretch et al.

It is certified that error appears in the above-identified patent and that said Letters Patent is hereby corrected as shown below:

Title page,
Item [75], Inventors, -- Bruce A. Hotton -- should be added to the listed inventors.
Item [57], ABSTRACT,
Line 3, delete "s".

Column 2,
Lines 15, 34 and 35, change "esthetic" to -- eutectic --.

Column 4,
Lines 1, 5, 21, 24 and 27, change "esthetic" to -- eutectic --.

Column 7,
Lines 15, 20, 22, 29, 35, 44, 59 and 60, change "esthetic" to -- eutectic --.

Column 8,
Lines 12, 23, 24, 26, 32, 38, 40, 44, 47, 52, 58, 62 and 65, change "esthetic" to -- eutectic --.

Column 9,
Lines 3, 7, 11, 17, 22, 26 and 32, change "esthetic" to -- eutectic --.

Column 10,
Lines 9 and 30, change "esthetic" to -- eutectic --.

Column 12,
Line 1, delete "s".
Line 56, change "esthetic" to -- eutectic --.

Column 13,
Lines 14, 22, 28, 33, 36, 39, 43, 46, 54, 58 and 60, change "esthetic" to -- eutectic --.
Lines 8 and 50, change "esthetic" (first occurrence) to -- eutectic --.
Lines 8 and 50, change "esthetic" (second occurrence) to -- eutectic --.
Lines 31 and 33, change "Of" to -- of --.

UNITED STATES PATENT AND TRADEMARK OFFICE

CERTIFICATE OF CORRECTION

PATENT NO. : 6,497,200 B2 
DATED : December 24, 2002
INVENTOR(S) : Gordon W. Stretch et al.

It is certified that error appears in the above-identified patent and that said Letters Patent is hereby corrected as shown below:

Column 14,
Line 1, change “esthetic” to -- eutectic --.

Column 16,
Lines 22 and 25, change “esthetic” to -- eutectic --.

Column 17,
Line 48, change “esthetic” to -- eutectic --.

Column 18,
Lines 2, 8, 10, 16, 22, 27, 30, 33, 37, 40, 48, 52, 54 and 59, change “esthetic” to -- eutectic --.
Line 44, change “esthetic” (first occurrence) to -- eutectic --.
Line 44, change “esthetic” (second occurrence) to -- eutectic --.

Signed and Sealed this

Ninth Day of September, 2003

JAMES E. ROGAN
*Director of the United States Patent and Trademark Office*